United States Patent [19]

Lane et al.

[11] 4,209,343

[45] Jun. 24, 1980

[54] METHOD FOR AIR TRANSPORT OF SANITIZING LIQUID TO A WAREWASHER

[75] Inventors: Buddy F. Lane; Louis F. Fraula, both of Troy, Ohio

[73] Assignee: Hobart Corporation, Troy, Ohio

[21] Appl. No.: 938,931

[22] Filed: Sep. 1, 1978

Related U.S. Application Data

[62] Division of Ser. No. 788,039, Apr. 15, 1977, abandoned.

[51] Int. Cl.[2] ..... B08B 9/00

[52] U.S. Cl. ..... 134/22 C; 134/36; 134/102; 134/29; 222/630

[58] Field of Search ..... 134/37, 36, 102, 100, 134/101, 94, 95, 22 R, 25 A, 29, 30, 22 C; 222/193, 630; 417/151; 68/17 R; 239/8, 9, 308, 337, 369

[56] References Cited

U.S. PATENT DOCUMENTS

| | | | |
|---|---|---|---|
| 1,860,136 | 5/1932 | Bunch | 239/289 |
| 2,244,292 | 6/1941 | Eldridge | 134/102 |
| 2,592,884 | 4/1952 | Fox et al. | 134/95 |
| 2,592,885 | 4/1952 | Fox et al. | 134/101 |
| 2,592,886 | 4/1952 | Fox et al. | 134/101 |
| 2,802,475 | 8/1957 | Stine | 134/102 |
| 3,044,092 | 7/1962 | Fox et al. | 134/100 |
| 3,139,890 | 7/1964 | Moran | 134/100 |
| 3,146,718 | 9/1964 | Fox et al. | 92/13.6 |
| 3,301,022 | 1/1967 | Low | 134/100 |
| 3,370,597 | 2/1968 | Fox | 134/100 |
| 3,434,882 | 3/1969 | Carolin | 134/29 |
| 3,465,761 | 9/1969 | Meeker et al. | 134/101 |
| 3,484,811 | 12/1969 | Weihe | 134/100 |
| 3,620,232 | 11/1971 | D'Angelo | 134/56 |
| 3,707,160 | 12/1972 | Query | 134/95 |
| 3,771,333 | 11/1973 | Jurjans | 68/12 R |
| 3,797,744 | 3/1974 | Smith | 134/100 |
| 3,804,297 | 4/1974 | Jurjans | 68/17 R |
| 3,825,187 | 7/1974 | Tatge | 239/312 |
| 3,881,328 | 5/1975 | Kleimola et al. | 134/100 |
| 3,903,909 | 9/1975 | Noren et al. | 134/101 |
| 3,941,211 | 3/1976 | Grutter et al. | 222/193 |
| 3,961,231 | 6/1976 | Gillespie | 222/70 |
| 3,982,609 | 9/1976 | Bouplon | 222/193 |

*Primary Examiner*—S. Leon Bashore
*Assistant Examiner*—Michael Goldman
*Attorney, Agent, or Firm*—Biebel, French & Nauman

[57] ABSTRACT

A rapidly moving air stream transports an air unstable sanitizing agent such as sodium hypochlorite from a liquid supply thereof directly to a tank containing water, such as the wash chamber of a dishwasher. The air is driven through a venturi powered aspirator which injects the sanitizing agent into the air stream and transports it to the warewasher for mixture with the water to provide an effective bactericide. Contact of the aspirated agent with air is preferably kept to a minimum by transporting it through a short hose interconnecting the aspirator and tank.

7 Claims, 3 Drawing Figures

METHOD FOR AIR TRANSPORT OF SANITIZING LIQUID TO A WAREWASHER

This is a division of application Ser. No. 788,039, filed Apr. 15, 1977, abandoned.

BACKGROUND OF THE INVENTION

This invention relates to warewashers such as dishwashing machines, and more particularly to systems for chemically sanitizing dishes during the rinse cycle in lieu of thermal sanitization. The use of solutions such as sodium hypochlorite for chemical sanitization is known in the prior art. See, for example, U.S. Pat. Nos. 2,592,884, 2,592,885, 2,592,886, 3,044,092, 3,146,718, and 3,370,597, all of which are assigned to the assignee of the present invention. As more extensively explained in these references, the addition of predetermined small quantities of sanitizing liquid to the rinse water can provide a sanitizing bactericide equivalent to a high temperature rinse, providing an effective alternative and potential savings of energy where hot water is not readily available or economical.

The sanitizing solution is usually either injected into the wash chamber at full strength or carried into the chamber by a stream of water. When water carries the sanitizing solution, the water is usually a diverted portion of the fresh rinse water, as exemplified in the above-noted references. Typically, the diverted water passes through a venturi which aspirates the sanitizing solution into the water at the desired rate. The water then carries the sanitizing solution in diluted form into the dishwasher chamber.

Direct injection of additives can cause distinct problems. The most common sanitizing solutions are corrosive at full strength, and if permitted to seep directly into the wash chamber can cause serious corrosion. They tend to corrode their injectors and adjacent items, such as the wash tank, causing them to leak. The injectors may also leak when the solution dries or crystallizes to the extent that it interferes with the operation of the valves within the injector system. Such leakage allows the solution to drip or seep from the injector into the wash chamber, the concentrated solution then literally eating through the tank at that location, even when the tank is made of stainless steel. Experience has shown that such injectors therefore require frequent service.

A flowing stream of water for aspirating and transporting the sanitizing agent into the wash chamber in diluted form will substantially reduce the likelihood of corrosion within the chamber, but will create other undesirable side effects. Water supplies frequently contain minerals which in solution and as undissolved solids cause build-up of harmful line-clogging deposits, particularly when chemical reactions between the minerals in the water and the chemical sanitizing agent cause the minerals to precipitate from the solution. Formation of such scale also occurs when parts of the system dry out during idle periods.

The chemical reaction between hard water and the most commonly-used sanitizing agent, sodium hypochlorite, causes calcium and magnesium in the water to collect on adjacent parts. These deposits can block the proper operation of valves and clog the needle orifice of the water powered venturi which aspirates the sanitizing agent into the water stream, initially varying the predetermined quantity of agent injected and eventually making the system ineffective to perform its intended bacteria-killing function. The operator is seldom aware that the strength of the killer is diminishing unless the liquid supply lasts an inordinate amount of time, or a qualified sanitarian makes a concentration check. Thus, frequent servicing due to water mineral deposits at critical locations for metering the chemical solution is a problem with prior art water driven aspirators. Additionally, the flowing pressure of the rinse water varies considerably from location to location and even changes from time to time in the same line. Since the proportions of water and sanitizing agent are to be kept within close limits, a downward variation of agent to water can result in a total loss of sanitizing effect.

It is thus clear that both direct mechanical injection of the chemical sanitizing agent into the tank and water venturi injection into a flowing stream of water for subsequent injection into the tank are fraught with serious reliability problems. A need thus remains for a reliable, durable, and substantially service-free system for adding a liquid sanitizing agent to the rinse water of a dishwasher, in which the sanitizing agent can be supplied without contacting any moving parts, which will continue to operate without degradation of system performance and reliability caused by deposits from entrained minerals in the available water supply, and which will not be adversely affected by changes in flow pressure of the water supply.

SUMMARY OF THE INVENTION

Briefly, the present invention meets the above needs and requirements by utilizing air as the transport medium for the chemical sanitizing agent. In a typical embodiment, a diaphragm type positive displacement air pump provides a supply of pressurized air to an air venturi. The air venturi aspirates the sanitizing agent, such as a 5%–6% solution of sodium hypochlorite, and transports it through a suitable conduit (e.g. plastic tubing) into the rinse system, which in the embodiment shown, is directly into the washer chamber, although it could also be into a separate premixing chamber or tank outside the wash chamber. The quantities of and duration of operation may be adjusted to provide a sanitizing effectiveness equivalent to that desired in the above noted U.S. Pat. No. 3,370,597.

Although a number of chemical sanitizing agents are known, the one most commonly used is sodium hypochlorite (NaOCl) because of its low cost, high effectiveness, high acceptability, and wide availability. However, it is well-known that sodium hypochlorite is unstable in air. It is not, therefore, readily apparent that air could be used successfully as the transport medium. The stability of the sodium hypochlorite solution can be improved by maintaining the pH above 7.6, which unfortunately also reduces the ratio of hypochlorous acid to hypochlorite ion, reducing the available hypochlorous acid which is the active agent in killing bacteria. Also, it is well known that chlorine dissipates rapidly from aqueous solutions, and in particular that sodium hypochlorite is unstable in air unless mixed with sodium hydroxide (which tends to make the solution basic, or increase its pH, reducing the bactericidal hypochlorous acid).

It is therefore clear that air is antagonistic to sodium hypochlorite, tending to cause it to break down and release its available chlorine. Air also causes the sodium hypochlorite to dry out during dwell periods, and the deposited salts can then jam the moving valves of direct injectors. Air also causes mineral-containing water to dry out during dwell periods, clogging the venturi orifices of water transport injectors.

The present invention assures maintenance of the potency of the air unstable liquid sanitizing agent while being transported by air, by aspirating and transporting the agent through a closed system from the liquid supply to the water with which it is to be mixed. Very little of the solution comes into contact with air, except for the small amount of air used for transport, and the contact is for only a short time. As a result, the solution is assured of reaching the tank of the washing machine with virtually its full strength intact.

An immediate benefit of the present system is that it has no moving parts such as valves which are exposed to the sanitizing agent. Corrosion resistant plastics are used for the tubing and the venturi, all but eliminating the risk of failure of the injection system due to corrosion. Of course, some crystalline salt residue of the solution usually remains and can dry within the tubing when the air flow stops. However, unlike the deposits caused by minerals such as calcium and magnesium, frequently found in hard water, these deposits are highly soluble salts which are quickly dissolved and scrubbed from the system during the next injection cycle. Thus, the problem of deposits attendant with water transport systems clogging critical parts has been virtually eliminated, and the salt deposits cannot jam moving parts or render seals ineffective because there are none. Laboratory models have been operated continuously to simulate life tests of several years with no problems.

It is therefore an object of the present invention to provide an improved chemical sanitizer injector and method for dispensing predetermined quantities of a chemical sanitizing liquid into a warewashing machine; which utilizes air as the transport medium for the sanitizing liquid; which aspirates the sanitizing liquid and blows it into the machine by means of a rapidly flowing stream of pressurized air; which preserves the sanitizing effectiveness of the liquid; which has no moving parts exposed to the sanitizing liquid; which requires little service attention; which is relatively unaffected by drying of the sanitizing liquid in the transport system; which can save energy by providing for reliable, low temperature, sanitary warewashing; and to accomplish the above objects and purposes in an uncomplicated, highly durable and reliable configuration readily suited to mass utilization in a wide variety of warewashing machine applications.

Other objects and advantages of the invention will be apparent from the following description, the accompanying drawings and the appended claims.

DESCRIPTION OF THE PREFERRED EMBODIMENT

Figure 1:
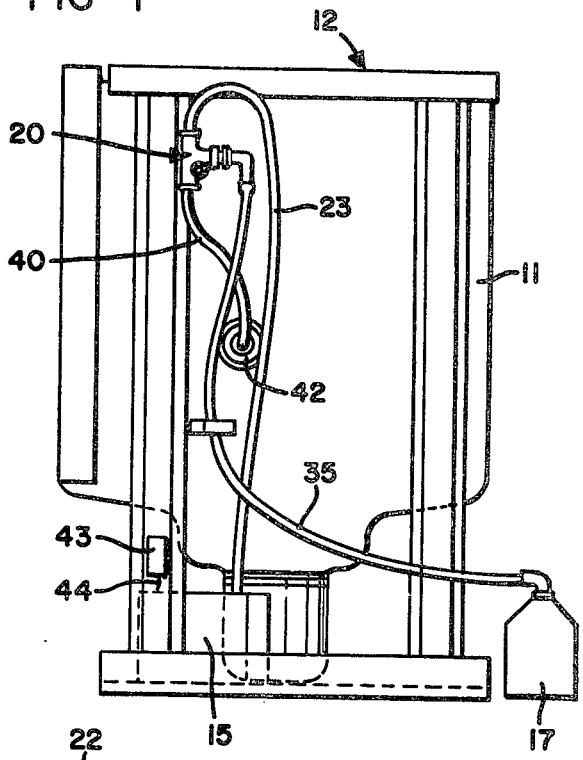
FIG. 1 is a side view of a dishwashing machine incorporating the sanitizer dispenser of the present invention.
Figure 2:
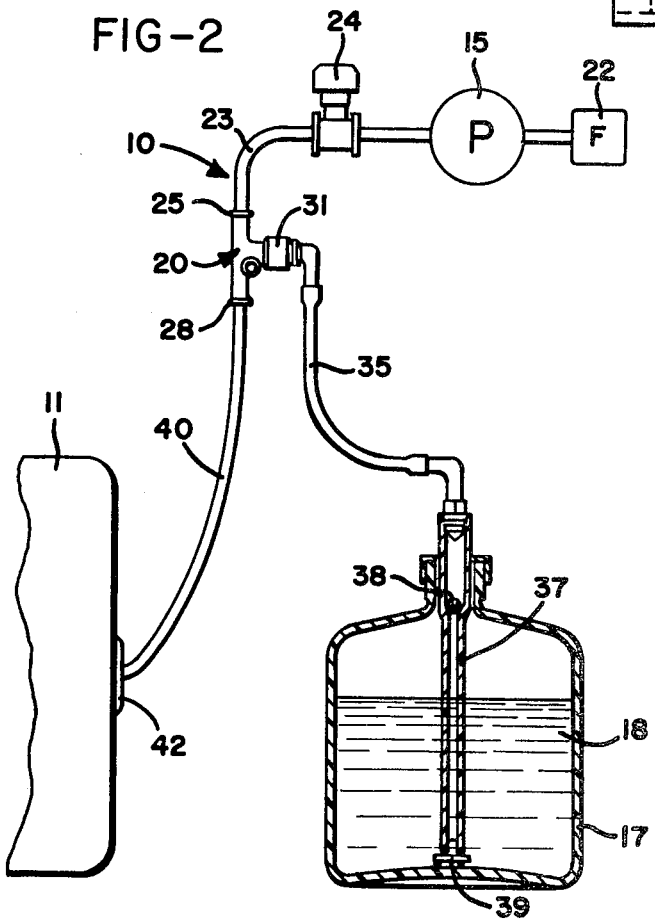
FIG. 2 is a schematic illustration of the FIG. 1 system.
Figure 3:
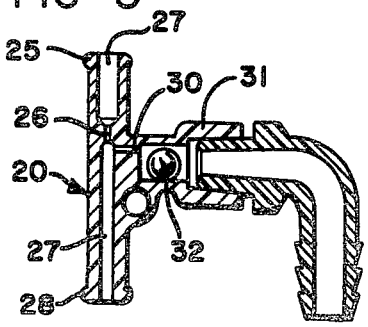
FIG. 3 is an enlarged cross sectional view of the venturi aspirator shown in FIGS. 1 and 2.

The dispenser system 10 of the present invention is designed for injecting a sanitizing liquid directly into a warewashing machine. As illustrated in FIG. 1, the sanitizing liquid is injected into the tank 11 of a dishwashing machine 12, which, in this type of machine is the wash chamber containing dishes to be washed. The dispenser system 10, which can be attached directly to the machine 12, includes an air pump 15, a supply, such as a bottle 17, of a sanitizing liquid or agent 18 (e.g., sodium hypochlorite), a venturi powered aspirator 20, and suitable pipes and/or tubing interconnecting these to one another and to the dishwashing machine 12. The aspirator 20 may be attached to tank 11, and atomize the agent directly therein without loss of available chlorine. However, where injection is made directly into a wash chamber containing dishes, it is preferred that the agent enter the chamber as coarse droplets rather than an atomized spray. The piping essentially assures this, because any atomization which occurs at the outlet of the aspirator quickly condenses onto the walls of the piping and exits therefrom in "spitting" fashion into the tank. It then drops by gravity directly into sump water contained in the tank bottom, and mixes with the water during circulation within the machine.

More specifically, the air inlet to pump 15 is through a filter 22 and the outlet is through an air supply pipe 23 which connects the pressurized air coming from the pump 15 to the aspirator 20. Pipe 23 may also include a pressure relief valve 24 to relieve pressure should one of the pipes or tubes downstream become damaged.

Pipe 23 carries the pressurized air into the inlet end 25 of aspirator 20. Within aspirator 20 the air then passes through a restricted portion 26 of the passageway 27 which connects the inlet end 25 of aspirator 20 to its outlet end 28. By well-known principles, the velocity of the air within the restricted portion 26 will be greater than that in pipe 23 and at the ends 25 and 28, causing a lower pressure than elsewhere. Opening into this lower pressure region is a metering channel 30 coming from a coupling 31 on aspirator 20. Channel 30 meters the sanitizing solution as it is drawn into passageway 27 by the reduced pressure. A ball check valve 32 is located in coupling 31 to permit the sanitizng solution to flow into passageway 27 but to prevent a reverse flow of air into coupling 31 should there be a pressure buildup, such as by pinching of a line between the aspirator 20 and the tank 11.

The sanitizing solution 18 is supplied to coupling 31 and channel 30 by a tube 35 which is connected at its other end to a standpipe 37 supported within the bottle 17 of solution 18. A ball 38 in standpipe 37 provides a visual indication when the solution available in the tube is flowing through tube 35, so that the machine operator can quickly determine whether a fresh supply of solution 18 is needed. A filter 39 filters the solution as it enters the bottom or inlet end of standpipe 37.

The outlet end 28 of the aspirator 20 is connected by a pipe 40 to a suitable fitting 42 on the side of the dishwashing tank 11. Fitting 42 connects the pipe 40 to the interior of the tank 11, so that the air and solution 18 which are blown through pipe 40 will be conducted directly into the dishwashing tank. The aspirator 20 must be located above bottle 17, so that the sanitizing solution 18 will not siphon into tank 11, once solution flow starts.

The dishwashing machine 12 may be controlled by a conventional timer 43 which is connected electrically by a wire 44 to air pump 15. Then at the appropriate time in the sanitizing rinse cycle, the air pump is energized, causing a flow of air through pipes 23 and 40. Ideally the air pump is energized as the rinse water is being recirculated through the spray system in the tank to immediately capture any mist which might be created and thus prevent its escape through the venting system (not shown) found on all dishwashers. The aspirator 20, which is located in the pipes, then aspirates the sanitizing solution 18 into pipe 40 for transportation into the tank. The air pump is actuated and the venturi, pump, pipe, and tubes are sized and adjusted to aspirate a predetermined quantity of the sanitizing liquid and to transport it into the tank with minimal dwell time in pipe 40. Tests have been conducted which show that the sanitizing solution flows through the tubes as a coarse stream whether the aspirator is operated at a high pressure which creates an atomized mist, or a lower pressure to create droplets only. The coarse stream has been observed both as a continuously flowing stream and as a stream of large droplets. In either case, effective exposure of the sanitizing liquid 18 to air prior to mixing with the water within the tank is minimized. That agent reaching the tank is immediately washed into the sump water by the spraying action inside the tank at the time the sanitizing solution is introduced.

In the preferred embodiment, pump 15 is a diaphragm pump, model DOAR-101, manufactured by GAST, and providing an output of 0.75 CFM at 13 PSIG. Pipes 23 and 40 are plastic tubing having interior diameters of approximately ¼". Pipe 35 is plastic tubing having an interior diameter of approximately ⅛". Pressure relief valve 24 is set to open at approximately 17–20 PSIG. As stated earlier, a common sanitizing agent 18 is a 5.2% sodium hypochlorite solution. Within aspirator 20, the passageway 27 on the inlet end 25 has a diameter of 0.156", and on the outlet end 28 of a diameter of 0.110". The restricted portion 26 has a diameter of 0.054". The metering channel 30 has a diameter of 0.048".

The proper quantity of sodium hypochlorite solution 18 is preferably injected after a predetermined quantity of rinse water, for example nine quarts, has been introduced into the tank 11 and is being recirculated upon articles supported within the tank for cleaning and sanitization. In such circumstances, timer 43 is set to operate pump 15 for 12 seconds, dispensing approximtely 13.5 cc of the 5.2% NaOCl solution. When mixed with the nine quarts of water this gives 75.3 ppm of chlorine. It has been found that tube 35 can be as long as 5 feet or more without impairing the proper operation of the dispenser system 10. Thus, bottle 17 may be located outside tank 11, and preferably at an accessible location outside machine 12 for convenient replacement as needed.

As may be seen, therefore, the present invention provides numerous advantages. It is uncomplicated, inexpensive and highly reliable. No moving parts are exposed to the corrosive effects of the sanitizing solution. Failures and frequent servicing due to deposits from hard water have been eliminated. Further, any crystalline precipitates which might be deposited within the system from previous drops of the sanitizing liquid are highly soluble and are therefore quickly and easily cleansed and purged by the air and solution during a subsequent injection. The invention thus provides a practical, durable and reliable system for warewashing machines which can provide substantial energy savings and has the versatility and capability to be used for injecting air unstable chemical sanitizers, such as sodium hypochlorite or like bactericidal solution, during any cycle desired. The solution can therefore be injected during wash cycles, for example, as well as the traditional rinse cycle. If desired, the invention may also be used with plural injectors for different compounds. Similarly, air pump 15 may be suitably valved for operating various injectors, and/or another source of compressed air, if available, may be used.

While the method herein described, and the form of apparatus for carrying this method into effect, constitute preferred embodiments of this invention, it is to be understood that the invention is not limited to this precise method and form of apparatus, and that changes may be made therein without departing from the scope of the invention.

What is claimed is:

1. For use in a washing machine having a tank containing a predetermined quantity of water for spraying onto food-associated articles within the machine to clean and sanitize them, a method for dispensing a predetermined quantity of an air unstable chemical sanitizing liquid, such as a saline solution of sodium hypochlorite, by means of air transport of the liquid into the water, comprising the steps of:

(a) actuating a source of compressed air for a predetermined time period, (b) using the compressed air to aspirate the sanitizing liquid from a supply thereof, and (c) transporting the sanitizing liquid to the tank, by means of the compressed air, with minimum effective exposure of the sanitizing liquid to air prior to mixing with the water within the tank.

2. The method of claim 1 wherein the liquid is transported from the supply thereof through a pipe, and wherein said transporting step further comprises cleansing the pipe of precipitates previously deposited from sanitizing liquid which remained in the pipe following a previous actuation of the source of compressed air.

3. The method of claim 1 wherein the aspirated liquid enters the tank as a substantially unatomized coarse stream.

4. The method of claim 1 wherein the water is fresh water for simultaneously rinsing and sanitizing the washed articles as the final step in the cleaning thereof.

5. For use in a washing machine having a tank containing a predetermined quantity of fresh water for spraying onto food-associated articles within the machine to clean and sanitize them, a method for dispensing a predetermined quantity of an air unstable chemical sanitizing liquid, such as a saline solution of sodium hypochlorite, by means of air transport of the liquid into the water, for simultaneously rinsing and sanitizing the washed articles as the final step in the cleaning thereof, comprising the steps of:

(a) actuating a source of compressed air for a predetermined time period, (b) using the compressed air to aspirate the sanitizing liquid from a supply thereof, (c) transporting the sanitizing liquid through a pipe to the tank, by means of the compressed air, with minimum effective exposure of the sanitizing liquid to air prior to mixing with the water within the tank, and with simultaneous cleansing of the pipe of precipitates previously deposited from sanitizing liquid which remained in the pipe following a previous actuation of the source of compressed air, and (d) introducing the liquid into the tank as a substantially unatomized coarse stream.

6. The method of dispensing a predetermined quantity of an air unstable chemical sanitizing liquid, such as an aqueous solution of sodium hypochlorite, into a predetermined quantity of rinse water for mixing with the water and for dispersing by spraying onto washed articles used in conjunction with food, to disinfect the articles, comprising the steps of:

(a) supplying the predetermined quantity of rinse water in a tank, (b) directing air under a predetermined pressure along a confined path terminating at said tank, (c) creating a reduced pressure below atmospheric at a portion along said confined path as a result of air flow past said portion, (d) conducting said aqueous solution from a supply thereof at ambient pressure to said reduced pressure portion by evacuation through a conduit and then transporting the solution from said portion to said tank by air flow through said path, and, (e) maintaining the pressurized air in the confined path for a predetermined time period calculated to withdraw the predetermined quantity of aqueous solution from the supply and convey it to the tank.

7. The method of claim 6 wherein the solution is evacuated through said conduit in a continuous liquid stream, and further comprising the step of reducing said continuous stream to discrete droplets upon reaching said reduced pressure portion.

* * * * *